US007007411B2

(12) United States Patent
Davis

(10) Patent No.: US 7,007,411 B2
(45) Date of Patent: Mar. 7, 2006

(54) ARTICLE OF FOOTWEAR HAVING A FLEXIBLE INSOLE

(75) Inventor: Russell L. Davis, Wynne, AR (US)

(73) Assignee: Munro & Company, Inc., Hot Springs, AR (US)

( * ) Notice: Subject to any disclaimer, the term of this patent is extended or adjusted under 35 U.S.C. 154(b) by 183 days.

(21) Appl. No.: 10/699,653

(22) Filed: Nov. 4, 2003

(65) Prior Publication Data

US 2005/0091883 A1 May 5, 2005

(51) Int. Cl.
*A43B 23/00* (2006.01)
*A43B 9/02* (2006.01)
*A43B 13/28* (2006.01)

(52) U.S. Cl. ..... 36/107; 36/108; 36/18; 36/22 A; 36/30 R; 36/76 C

(58) Field of Classification Search ..... 36/107, 36/102, 103, 108, 3 B, 12, 14, 17 R, 17 PW, 36/18, 19 R, 22 A, 30 R, 44, 76 C
See application file for complete search history.

(56) References Cited

U.S. PATENT DOCUMENTS 3,601,908 A * 8/1971 Gilkerson ..... 36/43
4,463,505 A * 8/1984 Duclos ..... 36/30 R
4,852,275 A 8/1989 Bianchini et al.
5,768,801 A * 6/1998 Huff ..... 36/17 R
5,911,491 A * 6/1999 Huff ..... 36/17 R
6,098,313 A * 8/2000 Skaja ..... 36/28
6,321,469 B1 * 11/2001 Cretinon ..... 36/102
6,581,305 B1 * 6/2003 Ho ..... 36/102
6,601,319 B1 * 8/2003 Clements ..... 36/17 R
6,637,131 B1 * 10/2003 Lee ..... 36/17 R
6,713,006 B1 * 3/2004 Redin Gorraiz ..... 36/103
6,874,252 B1 * 4/2005 Nakano ..... 36/3 R
6,877,253 B1 * 4/2005 Issler ..... 36/12
2003/0121177 A1 * 7/2003 Lee ..... 36/17 R

* cited by examiner

*Primary Examiner*—Anthony Stashick
(74) *Attorney, Agent, or Firm*—Lawrence E. Laubscher, Sr.; Lawrence E. Laubscher, Jr.

(57) ABSTRACT

An article of footwear includes a flexible insole having a ball portion arranged below the ball of the user's foot, the bottom surface of the ball portion containing a plurality of transversely-arranged longitudinally-spaced flex grooves that define therebetween a plurality of flex bars which impart a desired degree of flexibility to the insole. A longitudinally-extending shank slot is provided beneath the arch portion of the insole member for receiving a bowed semi-rigid shank member that supports the arch portion of the user's foot. An annular sealing gasket may be provided in a sealing channel that extends around the flex grooves, flex bars and shank slot, thereby to prevent moisture from entering the depressions in the bottom of the insole member.

6 Claims, 5 Drawing Sheets

ARTICLE OF FOOTWEAR HAVING A FLEXIBLE INSOLE

BACKGROUND OF THE INVENTION

1. Field of the Invention

An article of footwear includes a flexible horizontal insole member formed by molding from a synthetic plastic material, the bottom surface of said insole member containing adjacent the ball of the user's foot a plurality of transversely-extending flex grooves that define therebetween a plurality of generally-parallel transversely-extending longitudinally-spaced flex ribs that impart flexibility to the ball portion of the insole relative to the user's foot. The bottom surface of the insole also contains adjacent the arch portion of the user's foot a longitudinally extending shank slot for receiving a rigid or semi-rigid bowed shank member.

2. Description of the Related Art

It is well known in the patented prior art to provide articles of footwear that make use of the well known Goodyear welt concept for securing together the upper and midsole components of the article of footwear, as shown, for example by the prior patents to Clements U.S. Pat. No. 6,601,319 (which is assigned to the owner of the instant application), and Bianchini, et al., U.S. Pat. No. 4,852,275, among others. In order to increase the flexibility of such footwear and to reduce the weight and cost thereof, various proposals have been set forth in the footwear industry.

The present invention was developed to provide an improved flexible, light-weight insole member that combines the multiple aspects of product design to reduce labor and material costs and production time throughout the Goodyear welt manufacturing process. Utilization of the flexible insole affords to the wearer a more stable and lighter article of footwear, while allowing the manufacturing process to proceed smoother and faster, and while cutting down on inventory needs, as for example, pry-ribs, glue for the ply-ribs, cork or other bottom filler.

BRIEF SUMMARY OF THE INVENTION

Accordingly, a primary object of the present invention is to provide a flexible insole component for an article of footwear, wherein the insole is formed by molding a flexible synthetic plastic material to form a light-weight component containing in its bottom surface beneath the ball portion of the user's foot a plurality of transverse grooves, thereby to define therebetween a plurality of integral transversely-extending longitudinally-spaced flex ribs that impart flexibility to the insole.

According to another object of the invention, the bottom surface of the insole contains beneath the arch portion of the user's foot a longitudinally-extending shank slot that receives a rigid or semi-rigid shank member, thereby to impart stability to and support for the arch portion of the user's foot.

Another object of the invention is to provide an insole of the type described above that is caused to be moisture-resistant by the provision of an annular compressible gasket member in a sealing channel arranged concentrically about the area containing the flex grooves and the shank slot, thereby to isolate the same against ambient moisture.

The light-weight flexible insole component of the present invention permits the manufacture of the article of footwear to flow in a smother, faster manner, and cuts down on inventory needs, such as ply-rib, glue for a ply-rib, cork, or other type of bottom filler.

BRIEF DESCRIPTION OF THE DRAWINGS

Other objects and advantages of the invention will become apparent from a study of the following specification when viewed in the light of the accompanying drawings, in which:

FIG. 11 is a sectional view taken along line 11—11 of FIG. 10.

DETAILED DESCRIPTION OF THE INVENTION

Figure 1:
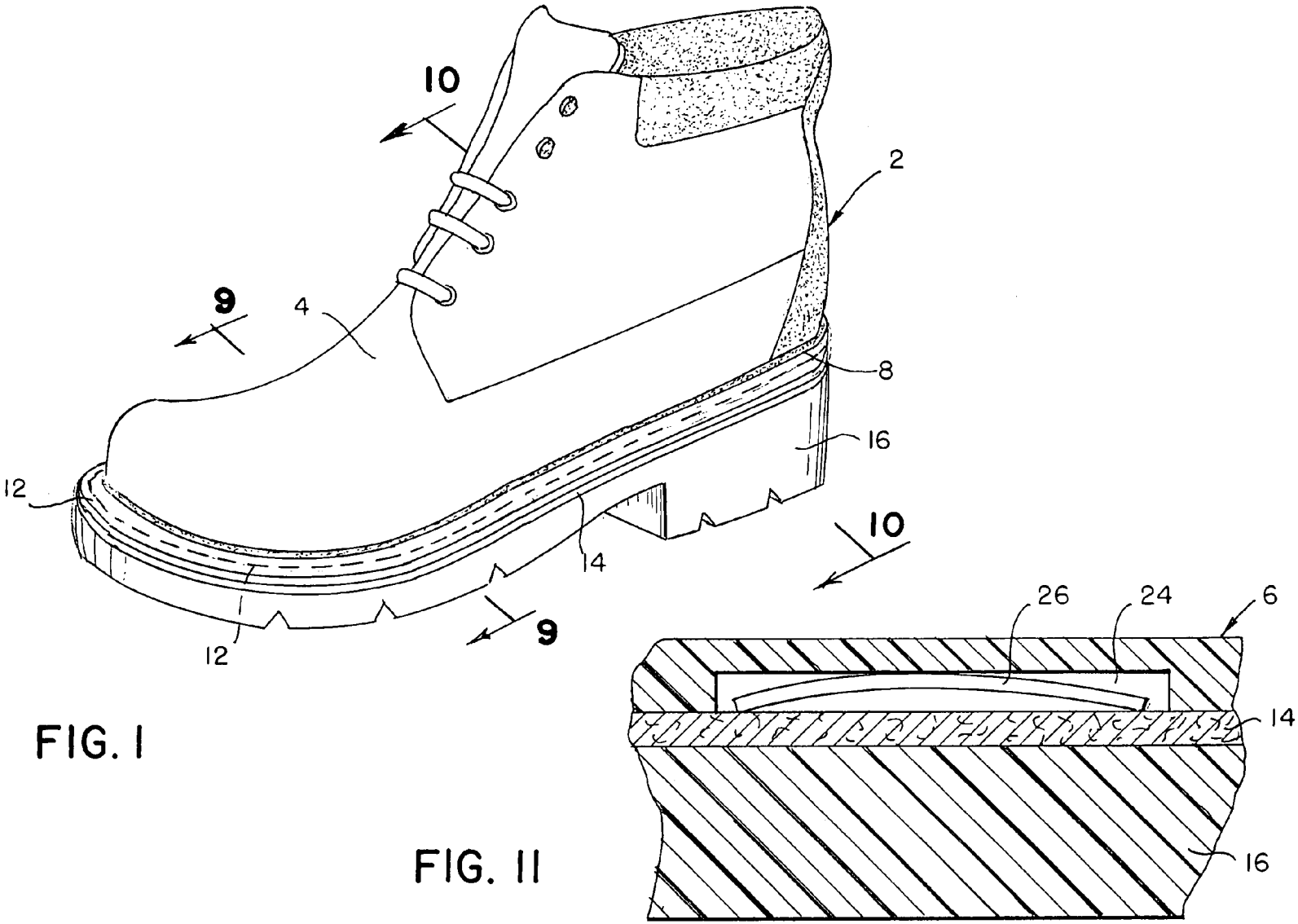
FIG. 1 is a perspective view of a boot that includes the present invention.
Figure 2:
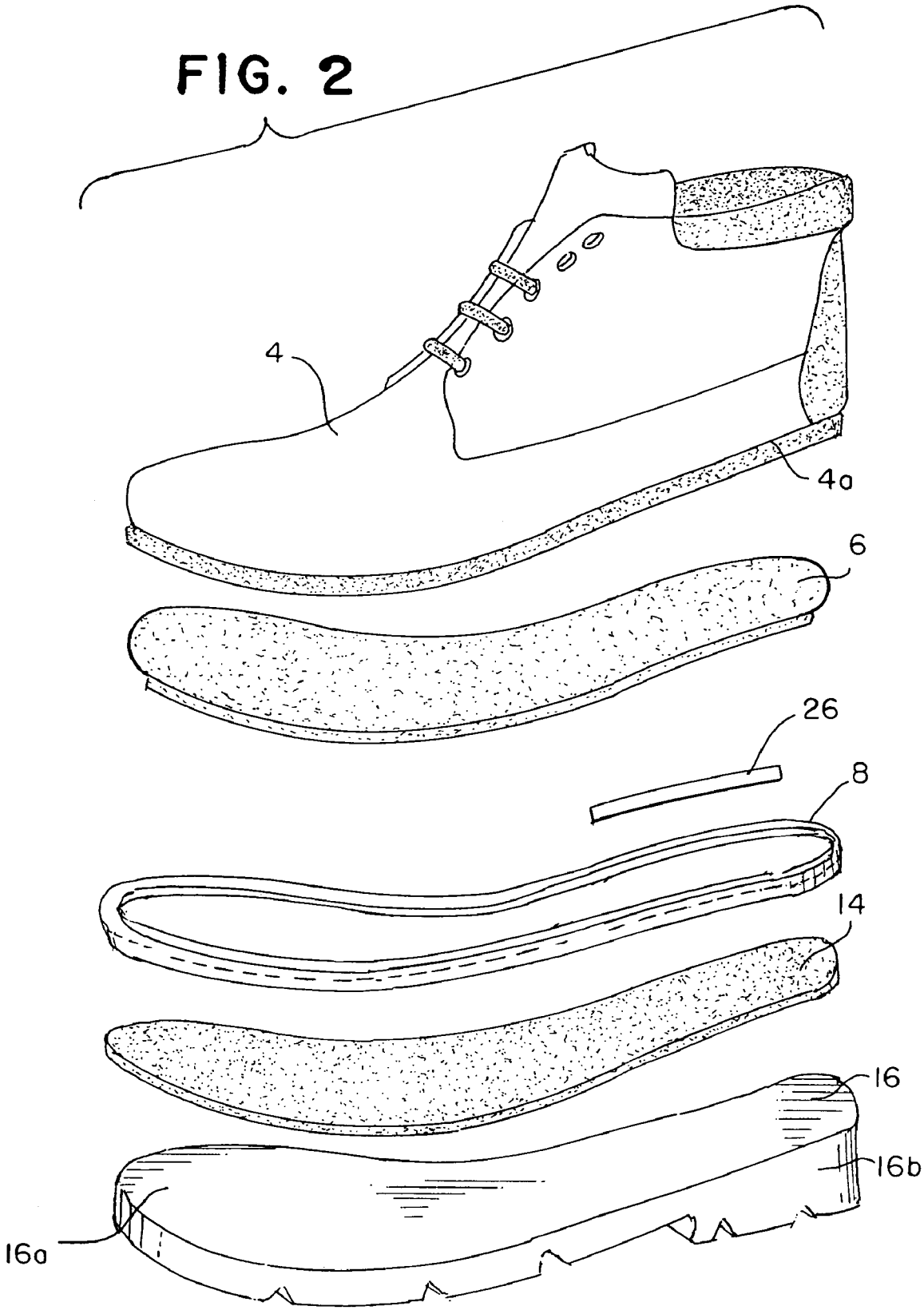
FIG. 2 is an exploded perspective view of the boot of FIG. 1.
Figure 9:
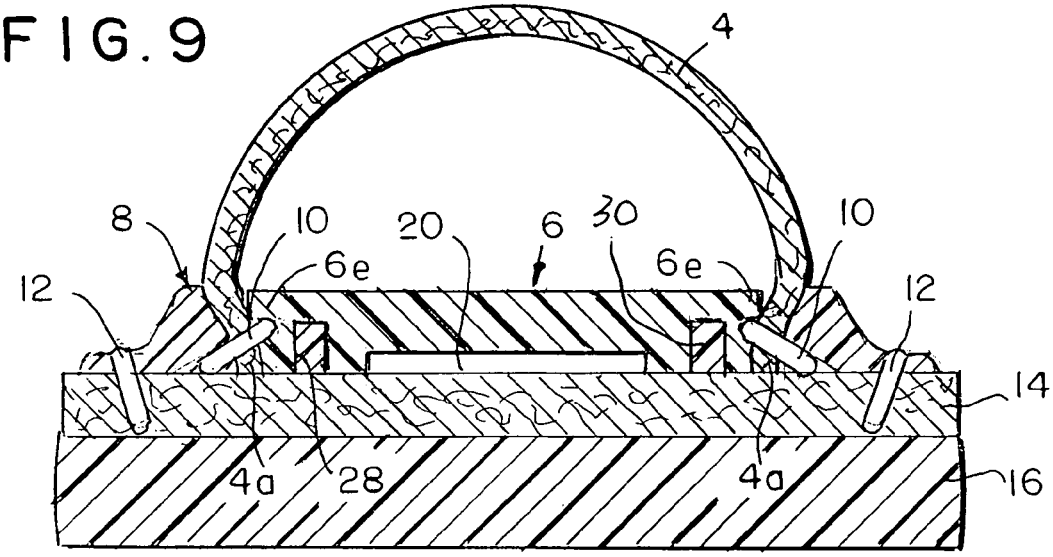
FIGS. 9 and 10 are sectional views taken along lines 9—9 and 10—10, respectively, of FIG. 1.
Figure 10:
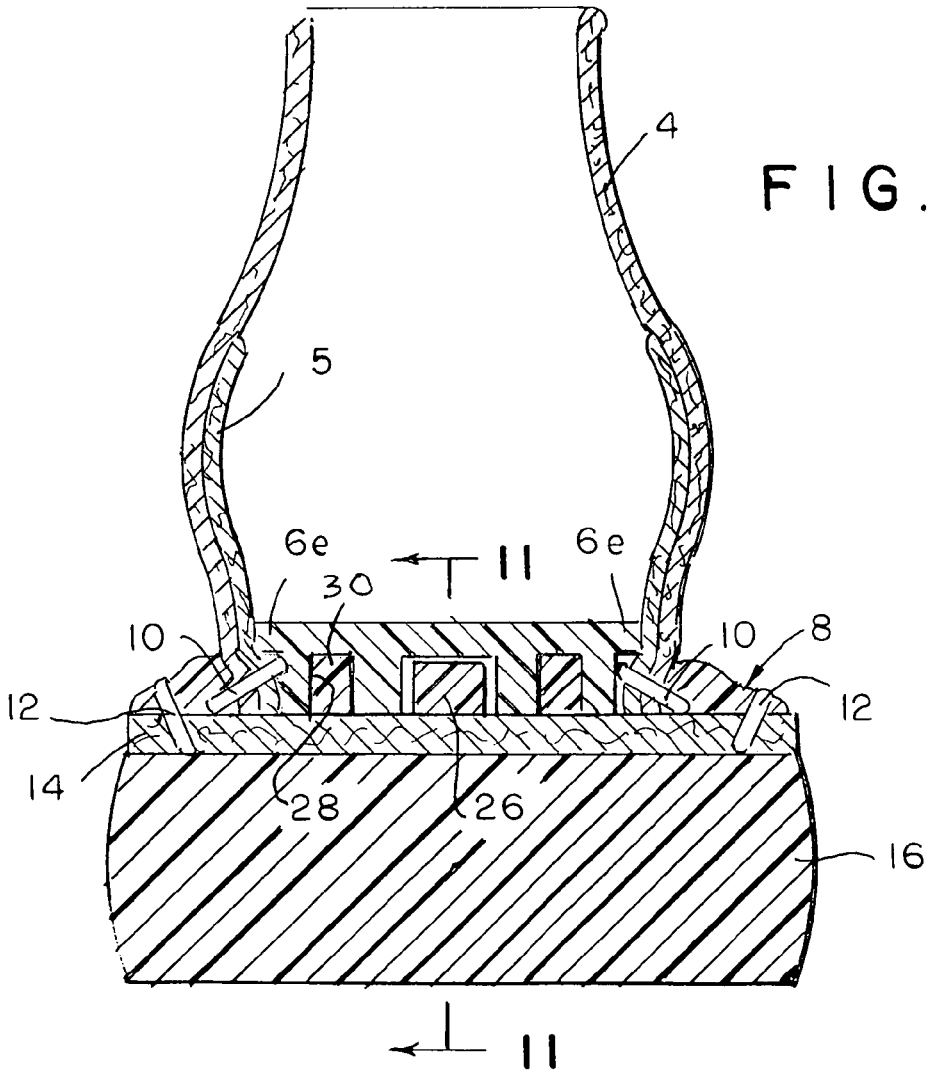

Referring first more particularly to FIGS. 1 and 2, the article of footwear 2, which in the illustrated embodiment is in the form of a boot, includes an upper member 4 that is open at the bottom and that conforms with the upper portion of a user's foot, an insole member 6 that is arranged within the open bottom edge portion 4*a* of the upper member 4, and an annular Goodyear welt 8 that is secured to the insole 6 and the upper body member 4 by inseam stitching 10 (FIGS. 9 and 10). The Goodyear welt is also secured by outseam stitching means 12 to the midsole member 14 to which is glued or stitched to the bottom or outsole member 16 having a forward toe portion 16*a* and a rearward heel portion 16*b*.

Figure 3:
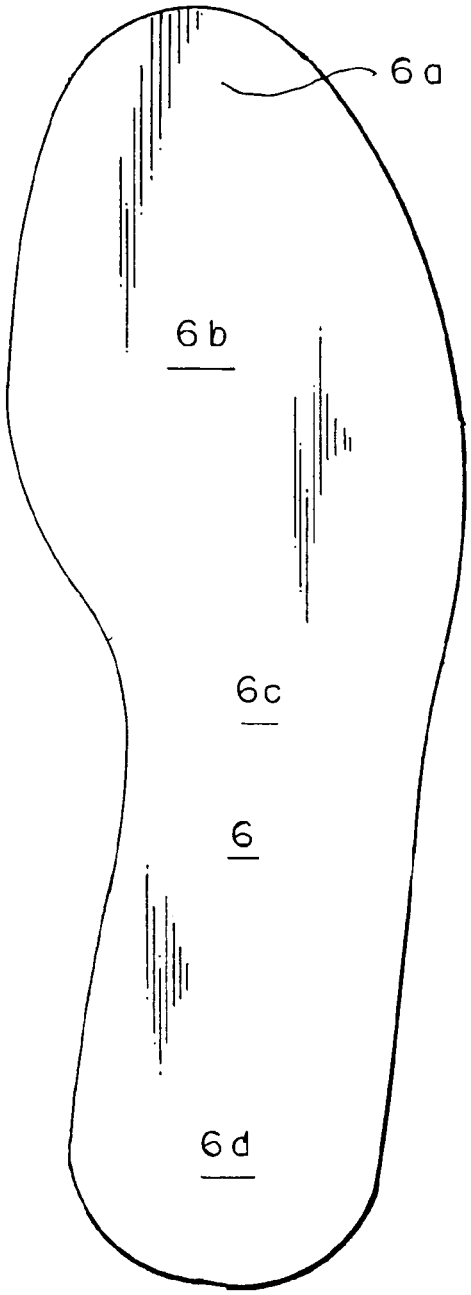
FIGS. 3 and 4 are top and bottom views, respectively, of the insole of FIG. 2.
Figure 4:
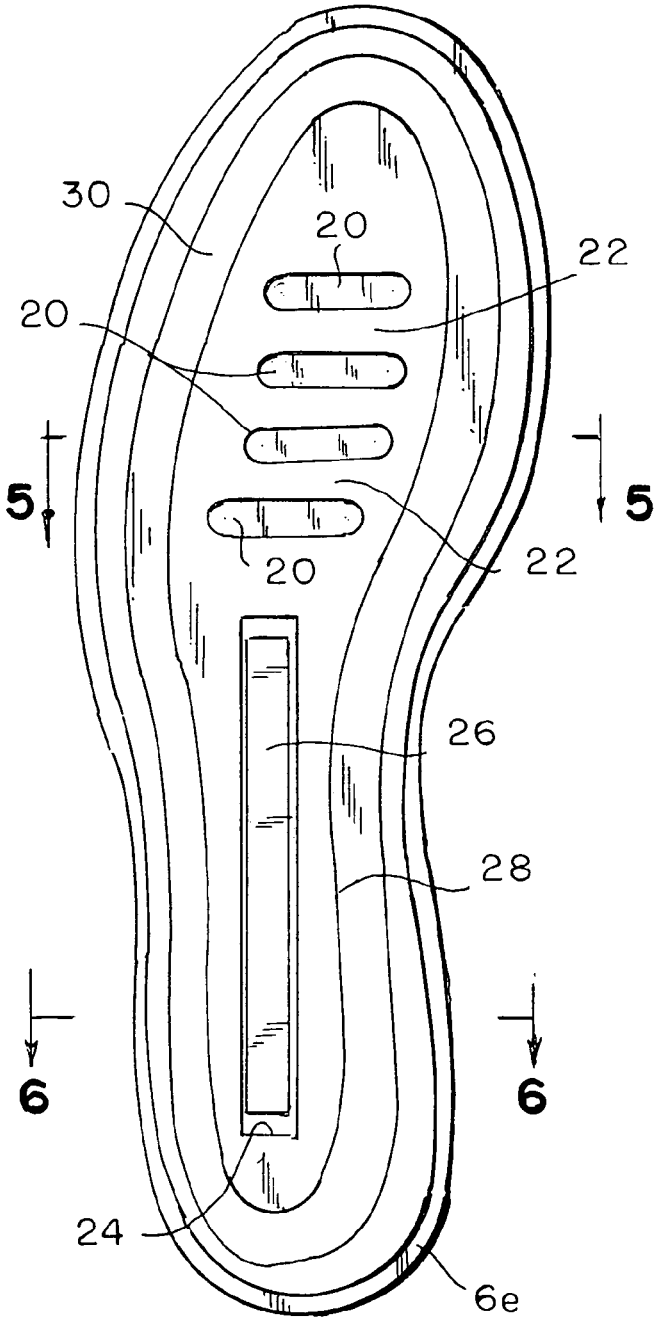

As shown in FIGS. 3 and 4, the insole member 6 has a toe portion 6*a*, a ball portion 6*b*, an arch portion 6*c*, and a heel portion 6*d*, respectively, positioned beneath the corresponding portions of the user's foot. Preferably, the flexible insole member 6 is formed by molding from polyurethane or other synthetic plastic material, such as polyvinyl chloride, polyurethane, or the like. As shown in FIG. 4, in accordance with the present invention, the bottom surface of the insole member 6 contains adjacent the ball portion 6*b* thereof a plurality of parallel, transversely-extending flex grooves 20 that define therebetween a plurality of parallel integral flex bars 22. These flex grooves and bars afford flexibility to the ball portion 2*b* of the insole member. Furthermore, beneath the arch portion 6*c*, the insole member 6 contains a longitudinally-extending shank slot 24 in which is mounted a bowed semi-rigid shank member 26, thereby to support the arch portion of the user's foot. The shank member 26 is preferably formed of fiberglass or similar hard synthetic plastic material, or of a metal such as steel. As shown in FIG. 11, the shank member 26 has a longitudinally bowed configuration, with the concave surface thereof facing downwardly.

Figure 5:
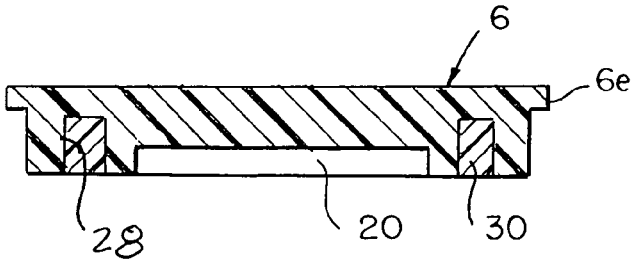
FIGS. 5 and 6 are sectional views taken along lines 5—5 and 6—6, respectively, of FIG. 4.
Figure 6:
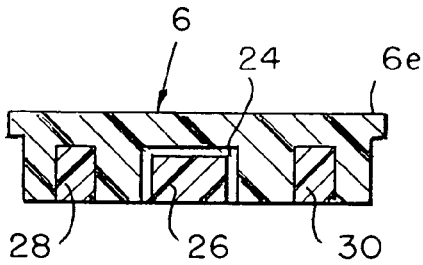
Figure 8:
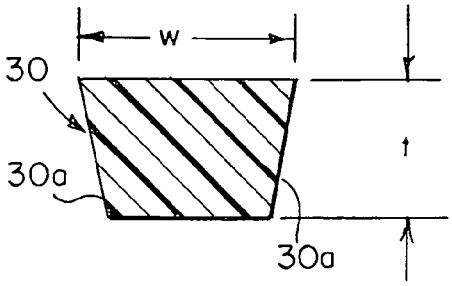
FIG. 8 is a sectional view taken along line 8—8 of FIG. 7.
Figure 7:
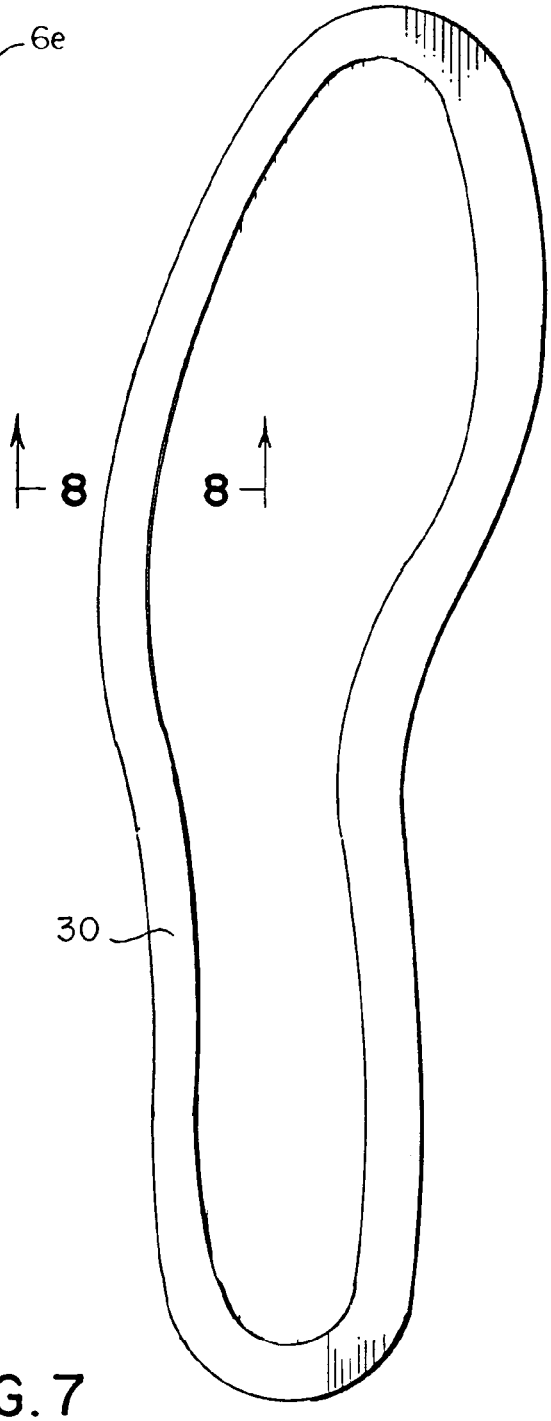
FIG. 7 is a top plan view of the gasket seal member of FIG. 2.

According to another feature of the invention, the insole member 6 contains adjacent and spaced from the peripheral side wall thereof a continuous sealing channel 28 (FIGS. 5 and 6) that receives an annular flexible sealing gasket 30 of FIG. 7. The sealing gasket 30 is formed from a water-resistant cushioning material, such as polyurethane, polyvinyl chloride, cork, or the like. As shown in FIG. 7, the configuration of the sealing gasket 30 corresponds generally with that of the sealing groove 28. Preferably, the thickness "t" of the gasket 30 is slightly greater than the depth of the sealing groove 28, thereby to effect compression of the gasket member and sealing between the adjacent surfaces of the midsole member and the insole member, as will be explained below. Also, the side walls 30*a* of the gasket are inwardly inclined relative to the horizontal bottom and vertical side walls of the sealing channel, thereby to facilitate insertion of the gasket member 30 within the sealing channel.

The upper portion of the peripheral side wall of the insole member 6 is provided with a continuous outwardly-extending horizontal lip portion 6*e*. As best shown in FIGS. 9 and 10, the cross-sectional configuration of the welt member 8 is such as to force the lower edge portion 4*a* of the upper member 4 in reversely bent relation below the horizontal outwardly-projecting peripheral lip portion 6*e* of the insole member, thereby to firmly connect together the components at this important seam location. The upper member 4 is preferably formed from leather or a suitable flexible synthetic plastic material, and may be partially lined by the layer 5 as shown in FIG. 10. It is initially formed around a foot form or shoe last and is attached to the insole member by gluing, stapling or wiring. Minor trimming operations are performed as the components are added to the upper member.

The midsole member 14 is formed of a suitable synthetic plastic cushioning material, and the bottom outsole member 16 is formed from a suitable durable synthetic plastic material, or laminate thereof. In addition to the mid-stitching 12, the midsole can be glued or adhesively fastened to the lower surface of the insole, thereby compressing the sealing gasket 30. The outsole is normally glued or stitched to the midsole.

It should be mentioned that the use of the sealing gasket 30—which serves as a water resistant material preventing moisture from entering the grooves 20 and the continuous sealing channel 28—is optional. Thus, footwear that does not need to be moisture resistant will not require the sealing gasket.

The flexible insole of the present invention is suitable for use in both men's and women's shoes and boots. The invention is not limited to dress, casual, work, service or military footwear. The insole is lightweight, and requires lower inventories of materials—i.e., eliminates the need for ply-ribs, glue, bottom fillers. It also results in lower production times, lower cost and quicker turn-around times. By integrally molding the flex ribs, bottom filler and shank slot into the insole, accurate positioning of the shank member is assured while affording greater flexibility to the insole.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. An article of footwear for receiving a user's foot having toe, ball, arch and heel portions, comprising:

(a) an upper member adapted to cover the upper portion of the user's foot, said upper member having an open bottom defining a bottom edge portion contained in a generally horizontal plane;

(b) a horizontal flexible insole member arranged within and secured to said upper member bottom edge portion, (1) said insole member being formed by molding from a flexible synthetic plastic material and having generally planar upper and lower surfaces, and toe, ball, arch, and heel portions arranged below the corresponding portions of the user's foot;

(2) said insole member lower surface containing beneath the ball portion of the user's foot a plurality of parallel transversely-extending longitudinally-spaced flex grooves that define therebetween a plurality of transversely extending flex bars, respectively, the ends of said flex grooves being spaced from the corresponding edge portions of said insole member;

(3) said insole member lower surface containing beneath the arch portion of the user's foot a longitudinally-extending shank slot;

(4) said insole member lower surface containing adjacent the peripheral edge of said toe, ball, arch and heel portions a continuous channel that extends in concentrically spaced relation around said flex grooves and said shank slot;

(c) an annular welt member extending concentrically around said upper member bottom edge portion;

(d) inseam stitching means securing said welt member to said upper member lower edge portion and to said insole member;

(e) a midsole member extending beneath said insole member and said welt member;

(f) means securing said midsole member to said welt member;

(g) an outsole member extending beneath and secured to said midsole member; and (h) a relatively rigid generally horizontal shank member arranged longitudinally in said shank slot, thereby to stiffen the arch portion of said inner sole member.

2. An article of footwear as defined in claim 1, wherein said shank member has a longitudinally-bowed configuration, thereby to define concave and convex surfaces on said shank member.

3. An article of footwear as defined in claim 2, wherein said shank member concave surface is directed downwardly.

4. An article of footwear for receiving a user's foot having toe, bail, arch and heel portions, comprising:

(a) an upper member adapted to cover the upper portion of the user's foot, said upper member having an open bottom defining a bottom edge portion contained in a generally horizontal plane;

(b) a horizontal flexible insole member arranged within and secured to said upper member bottom edge portion, (1) said insole member being formed by molding from a flexible synthetic plastic material and having generally planar upper and lower surfaces, and toe, ball, arch, and heel portions arranged below the corresponding portions of the user's foot;

(2) said insole member lower surface containing beneath the ball portion of the user's foot a plurality of transversely-extending longitudinally-spaced flex grooves that define therebetween a plurality of transversely extending flex bars, respectively;

(3) said insole lower surface containing beneath said arch portion a longitudinally extending shank slot;

(c) an annular welt member extending concentrically around said upper member bottom edge portion;

(d) inseam stitching means securing said welt member to said upper member lower edge portion and to said insole member;

(e) a midsole member extending beneath said insole member and said welt member;

(f) means securing said midsole member to said welt member; and (g) an outsole member extending beneath and secured to said midsole member;

(h) a relatively rigid generally horizontal shank member arranged longitudinally in said shank slot thereby to stiffen the arch portion of said inner sole member; said insole member lower surface containing adjacent the periphery thereof a continuous annular sealing channel that extends in spaced relation concentrically around said flex grooves and said shank slot; and further including:

(i) a compressible continuous annular sealing gasket arranged in said sealing channel, said sealing gasket being compressed between said insole and said midsole, thereby to seal said flex grooves and said shank slot against penetration by moisture.

5. An article of footwear as defined in claim 4, wherein said sealing channel has a horizontal bottom wall and a pair of vertical side walls; and further wherein the thickness of said gasket member is greater than the depth of said sealing channel, the walls of said gasket member being tapered inwardly in the direction of said channel bottom wall, thereby to facilitate the insertion of said gasket into said sealing channel.

6. An article of footwear as defined in claim 1, wherein said insole member has a peripheral wall the upper edge portion of which is provided with a continuous horizontal outwardly-extending peripheral lip portion, said welt member having such a cross-sectional configuration as to cause said upper member lower edge portion to be reversely bent back inwardly beneath said insole peripheral lip portion.

* * * * *